US005078950A

United States Patent [19]

Bernadet et al.

[11] Patent Number: 5,078,950

[45] Date of Patent: Jan. 7, 1992

[54] NEUTRON TUBE COMPRISING A MULTI-CELL ION SOURCE WITH MAGNETIC CONFINEMENT

[75] Inventors: Henri Bernadet, Saint-Michael Sur Orge; Xavier L. M. Godechot, Yerres; Claude A. LeJeune, Gif/Yvette, all of France

[73] Assignee: U.S. Philips Corporation, New York, N.Y.

[21] Appl. No.: 416,811

[22] Filed: Oct. 4, 1989

[30] Foreign Application Priority Data

Oct. 7, 1988 [FR] France ..... 88 13187

[51] Int. Cl.[5] ..... H05H 3/06; H01J 27/04

[52] U.S. Cl. ..... 376/116; 376/114; 376/117

[58] Field of Search ..... 376/114, 116, 117, 127, 376/129, 130

[56] References Cited

U.S. PATENT DOCUMENTS 3,265,896 8/1966 Redstone et al. ..... 376/114
3,569,756 3/1971 Reifenschweiler ..... 376/116
4,087,720 5/1978 Takagi ..... 376/127
4,782,235 11/1988 LeJeune et al. ..... 376/127

FOREIGN PATENT DOCUMENTS 7707357 1/1979 Netherlands ..... 376/114

*Primary Examiner*—Deborah L. Kyle
*Assistant Examiner*—Richard W. Wendtland
*Attorney, Agent, or Firm*—Paul R. Miller

[57] ABSTRACT

A sealed neutron tube is set forth which contains a low-pressure gaseous deuterium-tritium mixture wherefrom an ion source forms an ionized gas which is guided by a magnetic electron confinement field produced by magnets (8), which source emits the ion beams (3) which traversed an extraction-acceleration electrode (2) and which are projected onto a target (4) so as to produce therein a fusion reaction which causes an emission of electrons. In accordance with the invention, the ion source is of a multi-cell type formed by n Penning-type cells comprising a multi-hole anode (6) which is arranged inside the cathode cavity (7) in order to increase the ion current. The shape and/or the dimensions and/or the position of the multi-hole anode are adapted to the topology of the magnetic field.

11 Claims, 5 Drawing Sheets

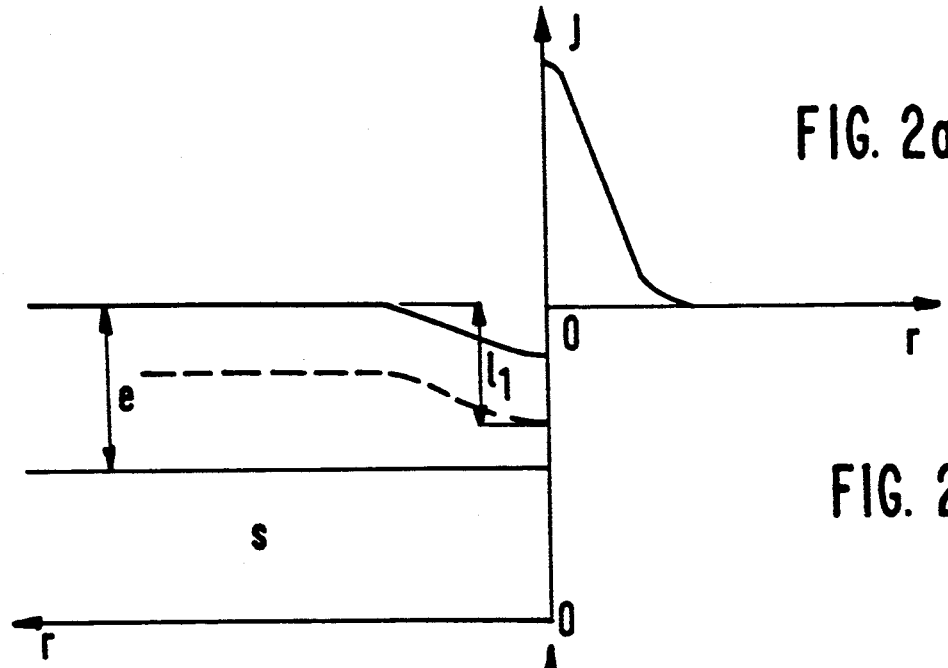
FIG. 2a
FIG. 2b
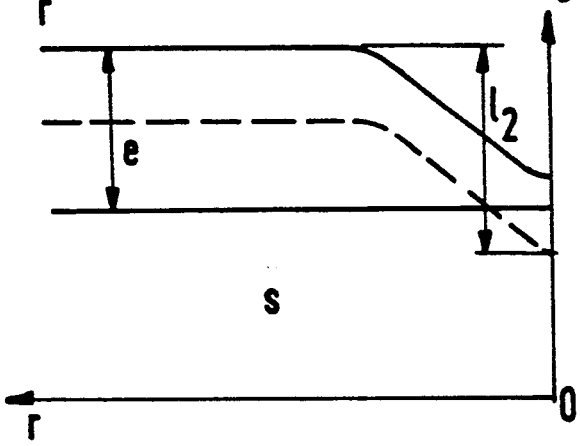
FIG. 2c
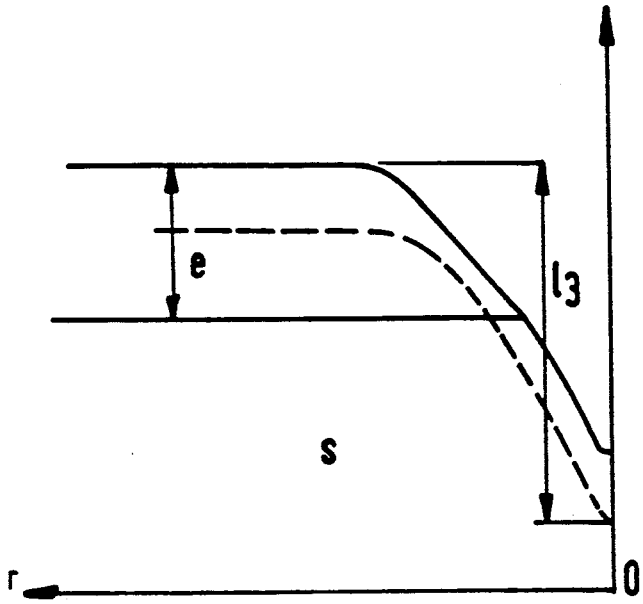
FIG. 2d

NEUTRON TUBE COMPRISING A MULTI-CELL ION SOURCE WITH MAGNETIC CONFINEMENT

The invention relates to a neutron tube which contains a low-pressure gaseous deuterium-tritium mixture in which an ion source comprising an anode and a cathode forms an ionised gas which is guided by a magnetic confinement field created by magnets or any other means suitable for creating this field produced by magnetic field producing means, which ion source emits via emission channels formed in the cathode, ion beams which traverse an extraction-acceleration electrode and which are projected with high energy onto a target electrode in order to produce therein a fusion reaction which causes an emission of neutrons.

BACKGROUND OF THE INVENTION

Neutron tubes of this kind are used in techniques for the examination of substances by means of fast, thermal, epithermal or fast cold neutrons: neutronography, analysis by activation, analysis by spectrometry of the inelastic diffusions or radiative captures, diffusion of neutrons etc.

In order to make these nuclear techniques as effective as possible, longer tube service lives are required for the corresponding emission levels.

The fusion reaction $d(3_H, 4_{He})n$ which supplies 14 MeV neutrons is most commonly used because of its large effective cross-section for comparatively low ion energies. However, regardless of the reaction used, the number of neutrons obtained per unit of charge in the beam always increases in proportion to the increase of the energy of the ions directed towards a thick target, that is to say mainly beyond ion energies obtained in sealed tubes which are available at present and which are powered by a high voltage which does not exceed 250 kV.

Erosion of the target by ion bombardment is one of the principal factors restricting the service life of a neutron tube.

The erosion is a function of the chemical nature and the structure of the target on the one hand, and of the energy of the incident ions and their density distribution profile on the surface of impact on the other hand.

In most cases the target is formed by a hydride (titanium, scandium, zirconium, erbium etc.) which is capable of binding and releasing large quantities of hydrogen without substantially affecting its mechanical strength; the total quantity bound is a function of the temperature of the target and of the hydrogen pressure in the tube. The target materials used are deposited in the form of thin layers whose thickness is limited by problems imposed by the adherence of the layer to its substrate. One way of restarting the erosion of the target, for example is to construct the absorbing active layer as a stack of identical layers which are isolated from one another by a diffusion barrier. The thickness of each of the active layers is in the order of magnitude of penetration depth of deuterium ions striking the target.

Another method of protecting the target, thus increasing the service life of the tube, consists in the influencing of the ion beam so as to improve its density distribution profile on the surface of impact. For a constant total ion current on the target, leading to a constant neutron emission, this improvement will result from an as uniform as possible distribution of the current density across the entire target surface exposed to the ion bombardment.

In a sealed neutron tube the ions are generally supplied by a Penning-type ion source which offers the advantage that it is robust, has a cold cathode (and hence a long service life), supplies large discharge currents for low pressures (in the order of 10 A/torr), and has a high extraction yield (from 20 to 40%) with small dimensions.

This type of source, however, has the drawback that it requires the use of a magnetic field in the order of a thousand gauss, parallel to the axis of the ionisation chamber, which introduces a substantial transverse inhomogeneity of the density of the ion current inside the discharge and at the level of the extraction taking place along the common axis of the field and the source.

Another drawback is due to the fact that the ions extracted and accelerated towards the target react with the gas molecules contained in the tube at a constant pressure of the first order in order to produce ionisation, dissociation and charge exchange effects which cause on the one hand a reduction of the energy on the target, that is to say to a reduction of the production of neutrons, and on the other hand the formation of ions and electrons which are subsequently accelerated so as to bombard the ion source or the electrodes of the tube.

This results in energy depots which increase the temperature of the electrode material such as molbydenum or stainless steel. The heating of these materials causes desorption of impurities such as carbon oxide enclosed thereby, thus deteriorating the quality of the tube atmosphere. The ions of impurities formed in the tube, for example $Co^+$, bombard the target with a pulverisation coefficient which is a factor from $10^2$ to $10^3$ higher than that of the deuterium-tritium ions, thus substantially increasing to the erosion. These effects are greater as the operating pressure in the neutron tube is higher.

SUMMARY OF THE INVENTION

It is the object of the invention to provide a source device which enables these drawbacks to be mitigated.

To achieve this, the device in accordance with the invention is characterized in that the ion source is of a multi-cell type which is formed by a structure of elementary Penning-type cells comprising, for the cells together, a cathode cavity in which there is arranged a multi-hole anode, the axes of the holes being aligned with the corresponding axes of the emission channels, the number of the holes being optimised so as to enlarge the extracted ion beam for equivalent coverage of the ion source, the shape and/or the dimensions and/or the position of the holes being adapted to the topology of the magnetic field.

It is also to be noted that a complementary discharge current gain can result from the increased length of the multi-cell ion source structure. This gain may be as high as a factor 2.

The resultant current increase of the new configuration of the source can thus be used to reduce the operating pressure of the neutron tube and to limit the detrimental occurence of ion-gas reactions.

For the multi-cell structure to be feasible it is necessary to adapt a magnetic field to suitable operation of a Penning structure, notably in regard to the relation between the magnetic induction and the hole radius of the multi-hole anode.

The variation of the magnetic field at the level of and in accordance with the shape of the lines of force can be corrected by increasing this hole radius, which implies the construction of anode structures of variable radius. Moreover, better adaptation of the shape of the anode to the magnetic lines of force can be obtained by replacing the cylindrical structures having a circular or square cross-section by truncated structures so as to make the generatrices of the cone segments coincide with the lines of force on the contours of the holes.

The emission of ions by the various structures takes place through channels which are formed in the cathode serving as an emission electrode. These channels, whose number is identical to that of the elementary cells, are arranged along the same axes of symmetry. When the structures have a circular cross-section, the diameter is a function of the applied electric field and of the thickness of the electrode.

An alternative version of this system consists of the addition of an expansion chamber underneath the cathodes in order to increase the uniformity of the densities in the vicinity of the emission which then takes place through orifices whose arrangement may be quasi-independent from that of the elementary cells.

In a neutron tube in accordance with the invention the extraction-acceleration electrode may be formed by an electrode comprising n orifices having axes which correspond to those of the n elementary cells, or a number of j orifices which is smaller than the number of n elementary cells and whose diameters are, therefore, larger than those of the emission channels and whose arrangement precludes any interception of the beams.

The thickness of this extraction-acceleration electrode may be increased in order to improve the mechanical strength and to enable cooling by forced circulation of liquid.

BRIEF DESCRIPTION OF THE DRAWINGS

The invention will be described in detail hereinafter with reference to the drawings.

FIGS. 2*a*, 2*b*, 2*c*, and 2*d* shows the erosion effects in the depth of the target and the radial ion bombardment density profile.

Identical elements in the Figures are denoted by corresponding reference numerals.

DESCRIPTION OF THE INVENTION

Figure 1:
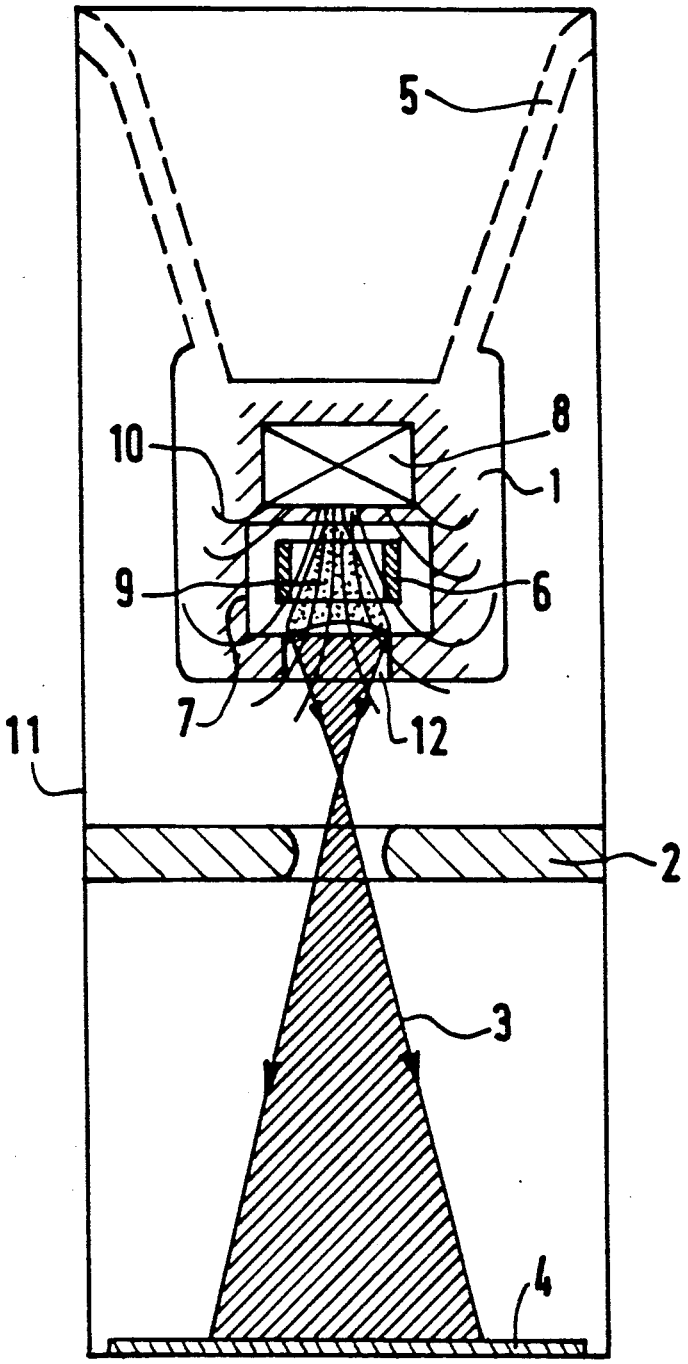
FIG.1 PRIOR ART
FIG. 1 shows the circuit diagram of a prior art sealed neutron tube.

FIG. 1 shows the basic elements of a sealed neutron tube 11 which contains a low-pressure gaseous mixture to be ionised, for example deuterium-tritium, and which comprises an ion source 1 and an extraction-acceleration electrode 2 where a very high potential difference exists between the ion source and electrode which enables the extraction and acceleration of the ion beam 3 and its projection onto the target 4 where a fusion reaction takes place causing an emission of neutrons of, for example, 14 MeV.

The ion source 1 is integral with an insulator 5 for the passage of the high-voltage power supply connector (not shown) and is, for example, a Penning-type source which is formed by a cylindrical anode 6, a cathode cavity 7 which incorporates a magnet 8 with an axial magnetic field which confines the ionised gas 9 to the vicinity of the axis of the anode cylinder and whose lines of force 10 exhibit a given divergence. An ion emission channel 12 is formed in the cathode cavity so as to face the anode.

The diagrams of FIG. 2 illustrate the target erosion effects.

FIG. 2*a* shows the density profile J of the ion bombardment in an arbitrary radial direction Or, starting from the point of impact O of the central axis of the beam on the surface of the target. The shape of this profile illustrates the inhomogeneous character of this beam where the very high density in the central part rapidly decreases towards the periphery.

FIG. 2*b* shows the erosion as a function of the bombardment density and the entire hydride layer having a thickness e and deposited on a substrate S is saturated with the deuterium-tritium mixture. The penetration depth of the energetic deuterium-tritium ions, denoted by a broken line, equals a depth $l_1$ as a function of this energy.

In FIG. 2*c* the erosion of the layer is such that the penetration depth $l_2$ is greater than the thickness e in the most heavily bombarded zone; a part of the incident ions propagates in the substrate and the deuterium and tritium atoms are very quickly oversaturated.

In FIG. 2*d* the deuterium and tritium atoms collect and form bubbles which form craters upon bursting and which very quickly increase the erosion of the target at the depth $l_3$.

The latter process immediately precedes the end of the service life of the tube, causing either a drastic increase of breakdowns (presence of microparticles resulting from the bursting of bubbles) or pollution of the target surface by the pulverised atoms which absorb the energy of incident ions.

Figure 3:
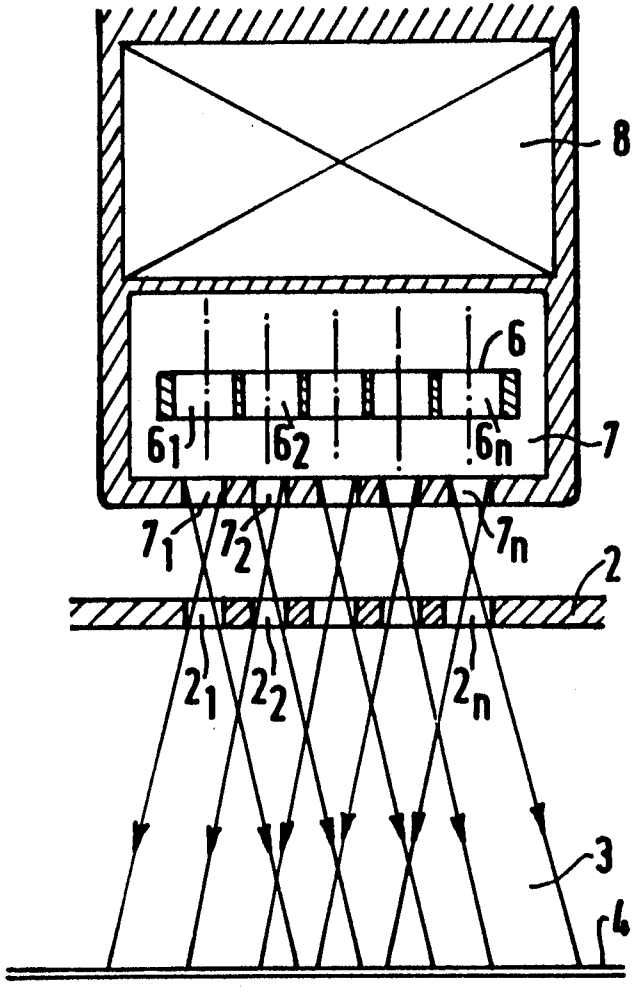
FIG. 3 shows the diagram of a neutron tube in accordance with the invention, comprising a Penning-type multi-cell ion source and an extraction-acceleration electrode which comprises as many orifices as there are cells.

FIG. 3 diagrammatically shows a neutron tube comprising a Penning-type multi-cell ion source which is formed by a cathode cavity 7 and a multi-hole anode 6 which carries a potential which is from 4 to 8 kV higher than that of the cathode cavity which itself is connected to a very high voltage of, for example 250 kV.

The magnet 8 forms a magnetic field in the order of one thousand gauss for confining the ionised gas.

The invention consists in the use of the properties of multi-cell discharge structures with confinement of the magnetic type, i.e. the fact that for the same anode section in the case of a multi-cell source structure the discharge current as well as the ion beam current extracted from this discharge are larger than the same currents obtained in the case of a mono-cell structure.

Moreover, it is more advantageous to use a multi-cell structure comprising n anode holes than a multi-cell structure comprising m holes if n>m. Each section of the structure comprising n holes is then smaller than each section of the structure comprising m holes. However, this advantage is achieved only if the anode section remains equivalent for the structures, enabling a reduction of the pressure of the gaseous mixture and hence a reduction of the probability of ion-gas reactions.

Thus, a new structure is formed which n cells, comprising the multi-hole anode 6 with n holes $6_1, 6_2, \ldots, 6_n$ and the cathode 7 in which the emission channels $7_1, 7_2, \ldots, 7_n$ wherefrom n ion beams are extracted are arranged opposite the anode holes. These multiple beams 3 are projected onto the target 4 by means of the extraction-acceleration electrode 2 which comprises a number of orifices $2_1, 2_2, \ldots, 2_n$ which is equal to the number of the beams, the orifices being arranged along the same axis.

Figure 4:
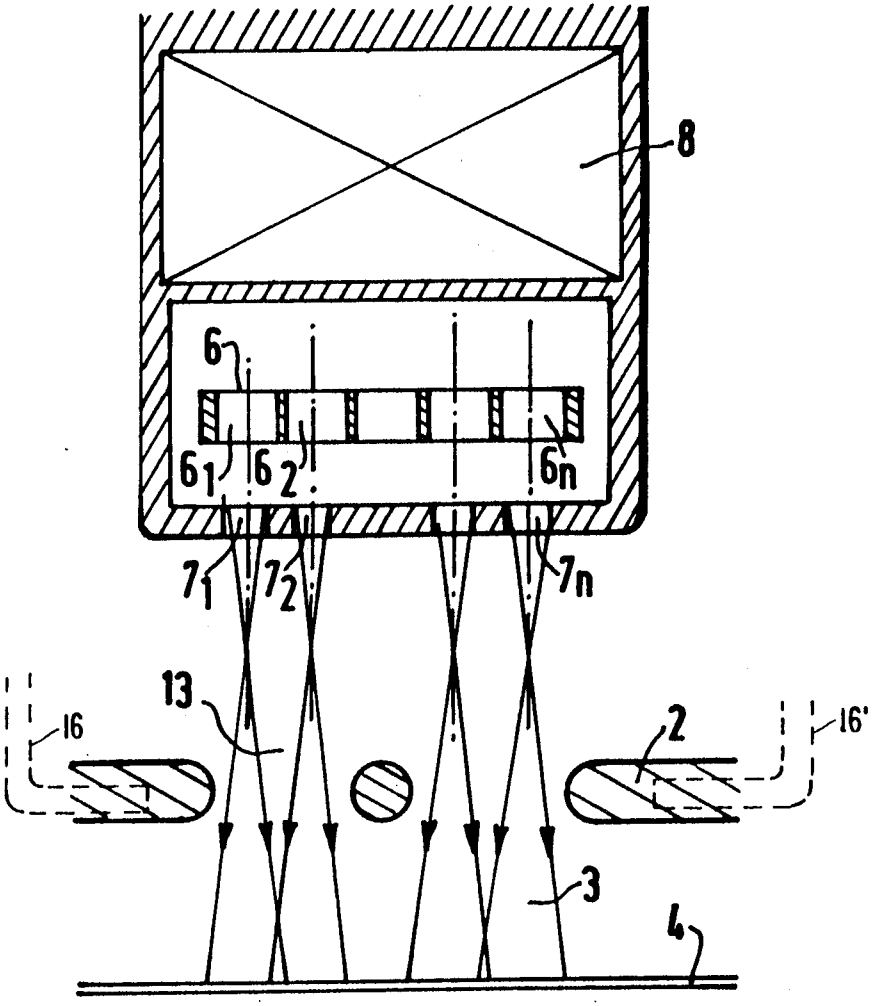
FIG. 4 shows a neutron tube in accordance with the invention, comprising a multi-cell ion source and an extraction-acceleration electrode which comprises a number of orifices which deviates from the number of cells.

In another embodiment of the neutron tube as shown in FIG. 4 the number of orifices formed in the extraction-acceleration electrode is smaller than the number of beams emitted by the source. For example, each orifice 13 of this electrode 2 allows for passage of two beams from the source as shown in the Figure.

A further improvement may be seen relative to FIG. 4 where a cooling channel 16, 16' is shown within the electrode 2 to circulate liquids. This electrode 2 is also shown as being thicker.

Figure 5:
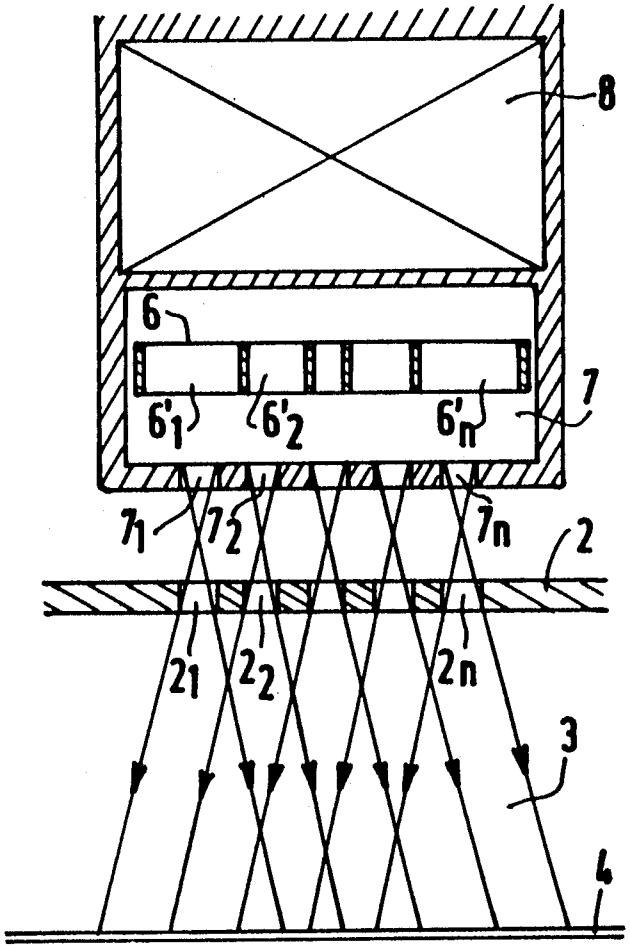
FIG. 5 shows a first alternative version of the neutron tube in accordance with the invention, comprising an ion source whose anode holes have a variable radius.

In a multi-cell ion source structure the divergence of the lines of force of the magnetic field shows that this field is very strong in the central zone and progressively decreases to a very low value at the periphery. In order to compensate for this variation, as indicated in FIG. 5 the anode holes $6'_1, 6'_2, \ldots, 6'_n$ are constructed so as to have a radius which is variable in the opposite sense with respect to the magnetic field, so that the product of the magnetic induction and the anode radius remains substantially constant. This arrangement enhances the uniformity of the ion current density.

Figure 6:
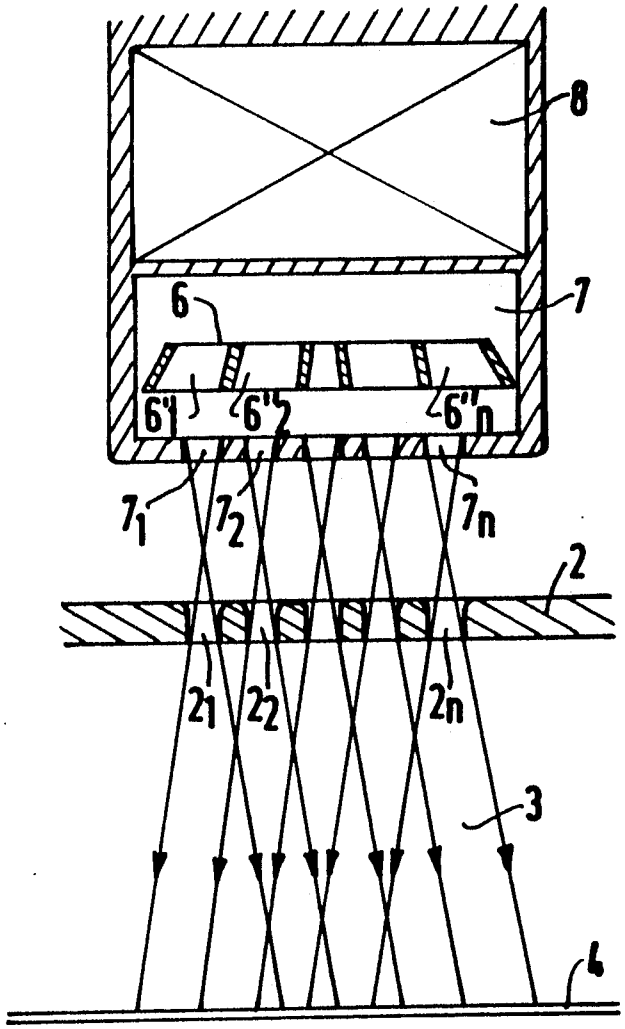
FIG. 6 shows a second alternative version of the neutron tube in accordance with the invention, comprising a source whose anode holes have a truncated shape.

The device shown in FIG. 6 leads to a substantial improvement because the anode holes $6''_1, 6''_2, \ldots, 6''_n$ have a truncated shape which follows approximately the shape of the lines of force of the magnetic field.

Figure 7:
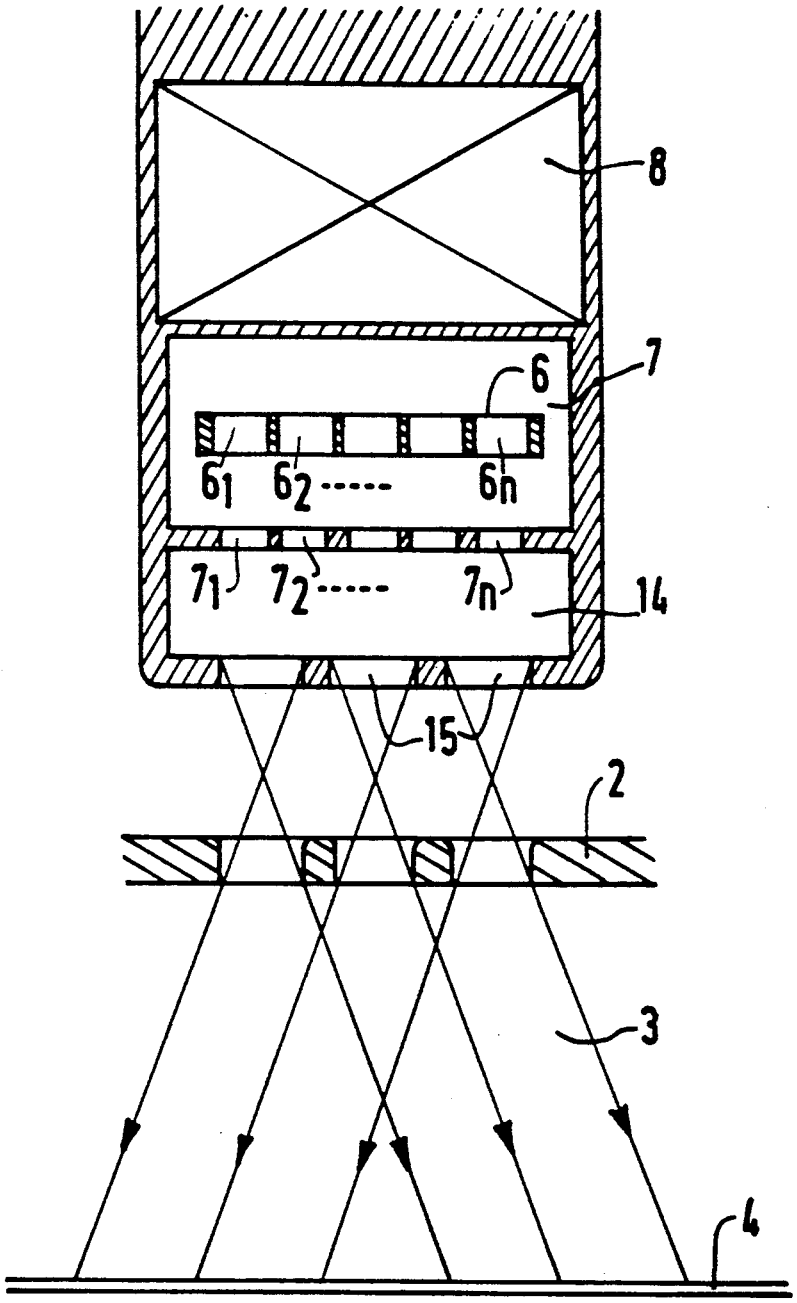
FIG. 7 shows a third alternative version of the neutron tube in accordance with the invention, comprising a source provided with an expansion chamber.

In FIG. 7 an expansion chamber 14 is arranged underneath the cathodes in order to enhance the uniformity of the ion densities. Emission takes place via orifices 15 whose number may be independent of the number of holes of the multi-hole anode.

Thus, the improvement of the ratio of the intensity of the beam to the pressure in the neutron tube which is offered by the multi-cell source structure in accordance with the invention can be used in various ways:

For an identical ion path, fewer pairs of ions/electrons are formed along the path of the ion beam and the energy deposited in the ion source by the re-accelerated electrons is less; the heating of the ion source is less and, consequently, the degasing of the constituent materials is reduced. The heavy ions resulting from such degasing are less numerous and their contribution to the erosion of the target is smaller. However, the mean energy of the deuterium-tritium ions is increased, enabling a reduction of the tube current.

For an identical beam current, the distance between the electrodes can be increased, thus decreasing the electric field in order to reduce cold emission phenomena.

For an identical integrated beam current (over the unit of time) the maximum current can be increased in the pulse d mode in the ratio of the pressures Pmax/P, where Pmax is the maximum operating pressure which does not change the mode of operation of the tube (change-over from discharge to arc mode).

Moreover, the distribution of the current on the target is more uniform because of the homogeneity of the discharge at the level of the emission channels on the one hand and the multiplication of the number of elementary beams on the other hand. This results in a decrease of the maximum ion density and, for an identical beam current, an increased service life.

We claim:

1. A neutron tube for forming high energy neutrons comprising (a) a sealed tube containing a low pressure gaseous deuterium-tritium mixture, (b) an ion source within said sealed tube, said ion source including a multi-hole anode structure and a cathode structure having a cathode cavity containing said multi-hole anode structure, wherein said ion source forms an ionized gas from said gaseous deuterium-tritium mixture, (c) magnetic means for producing a magnetic field to confine said ionized gas in guided paths, (d) emission channel means disposed in said cathode structure for emitting ion beams from said ion source, wherein said emission channel means include emission channels having axes aligned with corresponding axes of said multi-hole anode structure, (e) electrode means for extracting and accelerating said ion beams with a high energy, (f) target electrode means receiving said high energy ion beams for producing neutron emission, wherein said multi-hole anode structure has as optimum number of holes to enlarge ion beams extracted from said ion source, wherein said multi-hole anode structure has holes with at least one of shape, dimensions, and position to conform with topology of said magnetic field, and wherein said multi-hole anode structure has holes each with a radius increasing progressively toward a periphery of said multi-hole anode structure to aid conformation of said topology of said magnetic field.

2. A neutron tube according to claim 1, wherein said electrode means include a number of orifices equal to said optimum number of holes of said multi-hole anode structure, said orifices being disposed along respective axes of said emission channels.

3. A neutron tube according to claim 2, wherein said electrode means has an increased thickness to improve mechanical strength and to circulate cooling liquids.

4. A neutron tube for forming high energy neutrons comprising (a) a sealed tube containing a low pressure gaseous deuterium-tritium mixture, (b) an ion source within said sealed tube, said ion source including a multi-hole anode structure and a cathode structure having a cathode cavity containing said multi-hole anode structure, wherein said ion source forms an ionized gas from said gaseous deuterium-tritium mixture, (c) magnetic means for producing a magnetic field to confine said ionized gas in guided paths, (d) emission channel means disposed in said cathode structure for emitting ion beams from said ion source, wherein said emission channel means include emission channels having axes aligned with corresponding axes of said multi-hole anode structure, (e) electrode means for extracting and accelerating said ion beams with a high energy, (f) target electrode means receiving said high energy ion beams for producing neutron emission, wherein said multi-hole anode structure has an optimum number of holes to enlarge ion beams extracted from said ion source, wherein said multi-hole anode structure has holes with at least one of shape, dimensions, and position to conform with topology of said magnetic field, and wherein said multi-hole anode structure has holes with a truncated shape adapted to said topology of said magnetic field.

5. A neutron tube according to claim 4, wherein said electrode means include a number of orifices equal to said optimum number of holes of said multi-hole anode structure, said orifices being disposed along respective axes of said emission channels.

6. A neutron tube according to claim 5, wherein said electrode means has an increased thickness to improve mechanical strength and to circulate cooling liquids.

7. A neutron tube for forming high energy neutrons comprising (a) a sealed tube containing a low pressure gaseous deuterium-tritium mixture, (b) an ion source within said sealed tube, said ion source including a multi-hole anode structure and a cathode structure having a cathode cavity containing said multi-hole anode structure, wherein said ion source forms an ionized gas from said gaseous deuterium-tritium mixture, (c) magnetic means for producing a magnetic field to confine said ionized gas in guided paths, (d) emission channel means disposed in said cathode structure for emitting ion beams from said ion source, wherein said emission channel means include emission channels having axes aligned with corresponding axes of said multi-hole anode structure, (e) electrode means for extracting and accelerating said ion beams with a high energy, (f) target electrode means receiving said high energy ion beams for producing neutron emission, wherein said multi-hole anode structure has an optimum number of holes to enlarge ion beams extracted from said ion source, and wherein said multi-hole anode structure has holes with at least one of shape, dimensions, and position to conform with topology of said magnetic field, further comprising an expansion chamber disposed between said emission channel means and said electrode means, wherein said expansion chamber includes a plurality of orifices to pass said ion beams to said electrode means, said plurality of orifices being disposed and having a number which are independent of said holes of said multi-hole anode structure.

8. A neutron tube according to claim 7, wherein said electrode means include a number of second orifices equal to said optimum number of holes of said multi-hole anode structure, said second orifices being disposed along respective axes of said emission channels.

9. A neutron tube according to claim 8, wherein said electrode means has an increased thickness to improve mechanical strength and to circulate cooling liquids.

10. A neutron tube for forming high energy neutrons comprising (a) a sealed tube containing a low pressure gaseous deuterium-tritium mixture, (b) an ion source within said sealed tube, said ion source including a multi-hole anode structure and a cathode structure having a cathode cavity containing said multi-hole anode structure, wherein said ion source forms an ionized gas from said gaseous deuterium-tritium mixture, (c) magnetic means for producing a magnetic field to confine said ionized gas in guided paths, (d) emission channel means disposed in said cathode structure for emitting ion means from said ion source, wherein said emission channel means include emission channels having axes aligned with corresponding axes of said multi-hole anode structure, (e) electrode means for extracting and accelerating said ion beams with a high energy, (f) target electrode means receiving said high energy ion beams for producing neutron emission, wherein said multi-hole anode structure has an optimum number of holes to enlarge ion beams extracted from said ion source, wherein said multi-hole anode structure has holes with at least one of shape, dimensions, and position to conform with topology of said magnetic field, and wherein said electrode means includes a number of orifices less than said optimum number of holes of said multi-hole anode structure, said number of orifices being disposed to prevent interception of said ion beams.

11. A neutron tube according to claim 10, wherein said electrode means has an increased thickness to improve mechanical strength and to circulate cooling liquids.

* * * * *